United States Patent [19]

Van Dyck et al.

[11] 4,441,713

[45] Apr. 10, 1984

[54] METALLIC TENNIS RACKET WITH TORSION-RESISTANT HANDLE

[75] Inventors: Francis S. Van Dyck, Borsbeek; Thierry M. Dumortier, Hermee, both of Belgium

[73] Assignee: Fabrique Nationale Herstal, Belgium

[21] Appl. No.: 366,382

[22] Filed: Apr. 7, 1982

[30] Foreign Application Priority Data

Aug. 14, 1981 [BE] Belgium ..... 2/59300

[51] Int. Cl.[3] ..... A63B 49/12

[52] U.S. Cl. ..... 273/73 J; 273/73 H

[58] Field of Search ..... 273/80 B, 73 C, 73 H, 273/73 K, 73 J, 73 F

[56] References Cited

U.S. PATENT DOCUMENTS

| | | | |
|---|---|---|---|
| 3,879,035 | 4/1975 | Danchulis et al. | 273/73 C |
| 4,042,238 | 8/1977 | Theriault | 273/73 J X |
| 4,278,251 | 7/1981 | Lafourcade | 273/73 H X |

*Primary Examiner*—Richard C. Pinkham
*Assistant Examiner*—Matthew L. Schneider
*Attorney, Agent, or Firm*—Bacon & Thomas

[57] ABSTRACT

A racket of the type formed from a single metallic profile, shaped so as to define the frame, the throat-piece and the tail of the racket, the tail being defined by two mutually parallel ends of the profile, characterized in that the parallel ends are rigidly locked in relation to each other by means of at least one metallic plate disposed substantially along the whole length of the tail. In the handle portion of the racket, a metal honeycomb is disposed between the parallel ends of the profile.

1 Claim, 4 Drawing Figures

Fig.1
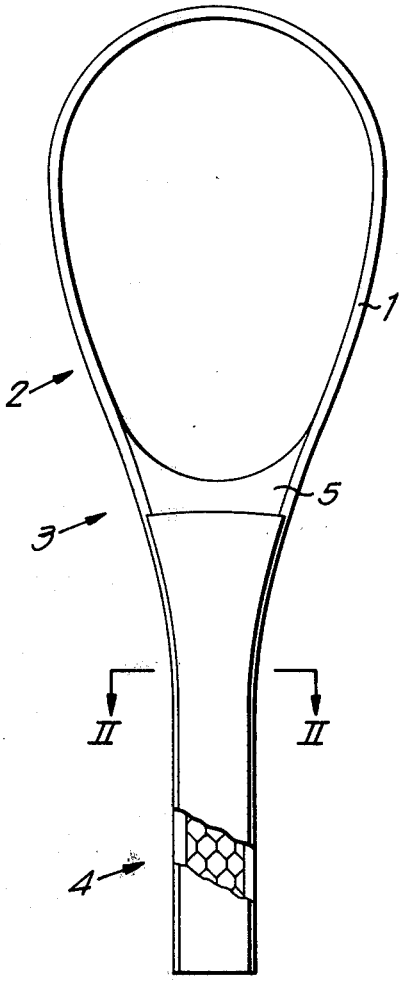
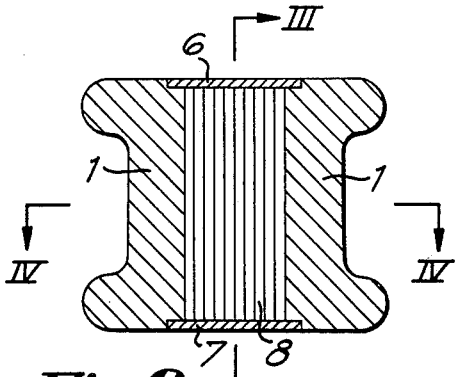
Fig.2
Fig.4
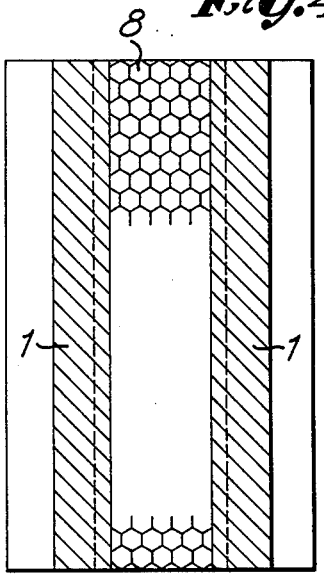
Fig.3
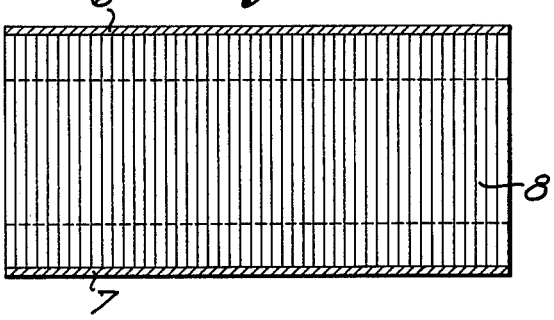

METALLIC TENNIS RACKET WITH TORSION-RESISTANT HANDLE

BACKGROUND OF THE INVENTION

The present invention relates to an improved racket, for instance, a tennis racket or similar device.

Tennis rackets are known which are mainly formed from a single metallic profile, shaped so as to define the frame, the throat-piece and the tail of the racket, a handle being slid around two mutually parallel ends of the aforesaid profile defining the tail.

Such a racket, which is known, is advantageous in that it is comparatively cheap to manufacture. Furthermore, its behavior in flexion is generally satisfactory. More or less unsatisfactory is, however, its torsional rigidity. This lack of rigidity results in a lack of precise control of the trajectory of the ball due to vibration the degree of which depends, of course, on the point of impact of the ball and on the striking force.

SUMMARY OF THE INVENTION

The object of the present invention is to improve upon the aforedescribed known type of racket so as to eliminate its indicated drawbacks.

For this purpose, the invention consists in a racket of the type described, but distinguished in that the aforesaid two parallel ends are rigidly locked, the one in relation to the other by means of at least one metallic plate disposed substantially along the whole length of the tail.

BRIEF DESCRIPTION OF THE DRAWINGS

In order to provide a clear understanding of the characteristics and advantages of the invention, an embodiment of same shall hereinafter be described in detail, with reference being made to the attached drawings in which:

FIG. 1 is an elevational view, in partial section, of a racket according to the invention;

FIG. 2 is a sectional view, on a larger scale, taken on the line II—II of FIG. 1; and FIGS. 3 and 4 are sectional views taken on the lines III—III and IV—IV, respectively, of FIG. 2.

The racket, which is shown in FIG. 1, is thus formed from a metallic profile 1, shaped so as to define the frame 2, the throat-piece zone 3 and the tail 4 of the racket. The tail 4 is defined by the two mutually parallel ends of the aforesaid profile 1, around which is slid a handle (not shown).

The throat-piece proper consists, in a known manner, of a separate part 5 assembled with the corresponding zones of the profile 1.

According to the invention, the mutually parallel ends of the profile 1 defining the tail 4 are assembled together by means of two metallic plates 6 and 7 so as to form, together with the aforesaid ends, a box structure.

The inside of this box structure advantageously houses a metallic honeycomb 8, assembled with the aforesaid plates 6 and 7 or with the aforesaid ends of the profile 1, for instance, by gluing. This construction considerably increases the rigidity in torsion of the racket, without significantly increasing its manufacturing cost.

It is clear that embodiments differing from the one described hereinabove are possible without departing from the scope of the subjoined claims.

What we claim is:

1. An improved tennis racket having enhanced torsional rigidity comprising a frame of a single metallic profile to form a head, a throat-piece and a tail, the portion of the frame defining said head comprised of substantially only said single metallic profile, the throat-piece being disposed between the head and the tail, the tail being defined by two parallel ends of the profile, two parallel metal plates extending over only substantially the full length of the tail for securing the two parallel ends together at a predetermined distance from each other, the parallel ends and the metal plates collectively defining a box space, and a metal honeycomb disposed only within the box space and secured to at least the plates or parallel ends.

* * * * *